United States Patent [19]

Hafele

[11] Patent Number: 4,836,170

[45] Date of Patent: Jun. 6, 1989

[54] FUEL INJECTION PUMP FOR AN INTERNAL COMBUSTION ENGINE

[75] Inventor: Walter Hafele, Fellbach, Fed. Rep. of Germany

[73] Assignee: Robert Bosch GmbH, Stuttgart, Fed. Rep. of Germany

[21] Appl. No.: 108,503

[22] Filed: Oct. 14, 1987

[30] Foreign Application Priority Data

Oct. 31, 1986 [DE] Fed. Rep. of Germany ..... 3637073
Jul. 23, 1987 [DE] Fed. Rep. of Germany ..... 3724409

[51] Int. Cl.[4] ..... F02M 34/00

[52] U.S. Cl. ..... 123/503; 123/501; 123/464; 123/495; 417/499

[58] Field of Search ..... 123/501, 500, 503, 495, 123/464, 357–359; 417/499, 490, 494

[56] References Cited

U.S. PATENT DOCUMENTS 2,965,087 12/1960 Bischoff ..... 125/01
3,667,437 6/1972 Dreisin ..... 123/501
4,661,051 4/1987 Nakamura ..... 417/499
4,705,005 11/1987 Guntert ..... 123/500
4,706,626 11/1987 Hafele et al. ..... 123/503
4,737,085 4/1988 Guntert ..... 123/501
4,737,086 4/1988 Yamaguchi ..... 123/500

*Primary Examiner*—Carl Stuart Miller
*Attorney, Agent, or Firm*—Edwin R. Greigg

[57] ABSTRACT

A fuel injection pump for internal combustion engines, having a plurality of in-line pump elements in which the supply onset is effected by means of control slides, one of which is axially displaceable on each of the pump pistons and by controlling relief conduits of the pump work chambers. The control slides are actuated via a torque shaft in that via driver tangs which are secured to the torque shaft by fastening parts screwed to the torque shaft, the control slides are axially displaced upon rotation of the torque shaft. For adjusting the stroke or axial position of the individual control slides to one another, spacer means, in particular shims are provided between the fastening part and the torque shaft in the stroke direction of the control slides.

31 Claims, 3 Drawing Sheets

FUEL INJECTION PUMP FOR AN INTERNAL COMBUSTION ENGINE

BACKGROUND OF THE INVENTION

The invention is based on a fuel injection pump for internal combustion engines as defined hereinafter. The problem in such pumps is that for exact regulation, the association, or relationship, of the axial position of the control slide with respect to the axial location of the control opening in the jacket face of the pump piston must be exactly the same for all the pump elements. In other words, closing or opening of the control opening by the control slide must take place at exactly the same axial, or stroke, position of the pump piston with respect to the rotational position of the drive shaft, in terms of the base circle of the cam. Errors in tolerance arise during manufacture, first during machining and then during assembly, and such errors can then become compounded. Typically, these errors in tolerance are eliminated by aligning the control slides identically with respect to the control openings before the pump is put into operation.

In a known fuel injection pump of this generic type (German Offenlegungsschrift No. 35 22 414), the driver tang is secured to a fastening clip that encompasses the torque shaft, so that once the fastening clip is loosened, the driver tang and hence the axial position of the control slide relative to the rotational position of the torque shaft is variable. Aside from the fact that this adjusted relative position between the driver tang and the torque shaft undergoes intrinsic variations given the heavy load and severe vibrations typical of a fuel injection pump, the effort of adjustment is also relatively great, because a direct comparison between the individual pump elements must be made during the adjustment, and when the fastening clips are set on the torque shaft, torque is exerted upon it, which in turn can cause adjustment errors. Another disadvantage is that the adjustment can be performed only after installation, since otherwise the individual association of the change in rotational position between the torque shaft and the fastening clip to the change in the axial or stroke position of the control slide cannot be reliably performed; this has the disadvantage that for setting purposes, it is necessary to intervene in the suction chamber, which is under feed pump pressure.

In another fuel injection pump of this generic type (German Offenlegungsschrift No. 35 40 052), the driver tang is eccentrically disposed on a spindle that passes radially through the torque shaft and is clamped firmly to it with a tensioning nut. When this spindle rotates, which can be effected via a screwdriver slot and a screwdriver after the tensioning nut is loosened, the driver tang is adjusted with respect to the axial position of the control slide, in accordance with the eccentricity of the driver tang. Once again, in this known apparatus, self-loosening of the established setting is even more disadvantageous, the smaller the frictional surfaces involved in the tightening of the spindle. Furthermore, this adjustment can likewise be made only after the torque shaft has been installed, and once again the suction chamber, which is under pressure, has to be opened. In yet another known fuel injection pump of this generic type (European patent application No. 0181402), a fork-like device having a gripper insert is used as the driver element, being either in the form of a tubular clip joined to a round torque shaft, or being joined to a torque shaft of polygonal cross section via a bolt disposed on the face end of this fork lever that faces toward the torque shaft. In the first case, the adjustment is admittedly relatively simple, effected by rotating the "tubular clip" on the torque shaft. There is the danger, however, that because of the vibrational strain on such systems the clip tension may very easily loosen, causing shifting or misalignment of the control association, possibly in the direction of an increasing fuel quantity, which causes the engine to race. The other version [with the polygonal shaft] is extremely unfavorable in terms of force transmission, because the effective contact surface in the longitudinal direction of the lever between the lever part and the torque shaft is relatively narrow, and besides, there is no way to make an adjustment of the desired kind mentioned above.

OBJECT AND SUMMARY OF THE INVENTION

The fuel injection pump according to the invention has the advantage over the prior art that very accurate settings can be performed, with very easily manufactured parts. The adjustment is performed with the torque shaft in the disassembled state; that is, the stroke errors are measured with the torque shaft in the installed state of the torque shaft, and later, in the disassembled state, these errors are corrected by varying the spacing, for example by removing or inserting shims or by rotating the fastening screws. The fastening is also capable of withstanding heavy loads, without the danger that it will work loose. Shifting out of alignment is impossible because of the selection of the rigid force-locking and form-locking connection.

In an advantageous feature of the invention, the torque shaft has a profiled cross section, at least in the vicinity of the fastening elements, with faces complementary to the adjusting faces of the fastening part that are oriented toward them. Preferably, the faces on the torque shaft are flat, but other face configurations can also be selected. The determining factor is that shims should be able to be fitted in between in a tolerance-free manner. A particularly simple solution is attained if the faces comprise a flat surface.

According to another advantageous feature of the invention, the fastening parts have guide faces on the side facing the torque shaft at least in the vicinity of the control slides that extend largely parallel to a plane extending through the pump piston axes. The result is vertical guidance of the fastening parts, that is, guidance extending parallel to the stroke direction, so that when the spacing of the adjusting face from the corresponding face of the torque shaft is changed, this change does in fact take place in a parallel manner. The guide face is preferably flat.

In an additional feature of the invention, the fastening parts have an angular or U-shaped cross section, having both the guide face that always directly contacts the torque shaft and the adjusting face. With the U-shaped cross section, it is possible for one leg of the U to lap over the torque shaft, which in this vicinity has a rectangular cross section, so that as a result the U-shaped part is guided exactly on the torque shaft. The coupler tang can then suitably be disposed on the other leg of the U, while the crosspiece of the U that joins the two legs has the adjusting face; this crosspiece is preferably secured to the torque shaft. When an angular fastening part is used, one of the two legs will advantageously have the guide face while the other has the adjusting face. Naturally, embodiments are also conceivable in which the fastening element is embodied as a profile ring, which is accordingly threaded onto the torque shaft and firmly clamped, for example by tensioning screws, in such a way that the shims or adjusting screws rest in a form-locking manner on the remote side, away from the screw connection.

According to a further advantageous feature of the invention, the fastening part is secured to the torque shaft with at least one screw. Preferably, such screws pass through the portion of the fastening part that has the adjusting face and have a radial fit there; in other words, especially when the fastening part is embodied with an angular cross section, the screws are embodied as so-called dowel screws. The screw also extends in a threaded bore of the torque shaft and with its head clamps the fastening part and the shims or adjusting screws against the torque shaft. Naturally, other kinds of screw fastenings are also conceivable.

According to another advantageous feature of the invention, the torque shaft has a profile cross section with a least two legs that are at right angles to one another and that cover the prismatic fastening part on two sides. The horizontal face, cooperating with the adjusting face of the fastening part, that extends transversely to the pump piston axis and points in the direction of the intake stroke is provided on one leg. As a result, a torque shaft of reduced weight and virtually the same torque stability is attainable, which also means that the bearings are under less strain. According to another advantageous feature of the invention the profile cross section is a U or an L that is open in the direction of the intake stroke, having a guide face oriented toward the fastening part and parallel to the axis of the tensioning screw; a vertical face that rests on the guide face is present on the fastening part. In this way, the driver tang of the fastening part is guided at right angles to the axis of the torque shaft, moreover lending the torque shaft itself an increased torsional rigidity.

In yet another feature of the invention, and depending on the profile cross section and the planar arrangements, the fastening part can have a prismatically shaped profile element, on which the coupler tang is secured for engagement with the transverse groove of the control slide.

According to the invention, the adjustment procedure is such that after a preliminary setting for an average vertical spacing between the torque shaft and the fastening part, the stroke error of the individual control slides is measured with the torque shaft in the installed state, and after the torque shaft is removed the change in spacing between the adjusting face and the face oriented toward it of the torque shaft is effected, by making a change at the spacer means.

The invention will be better understood and further objects and advantages thereof will become more apparent from the ensuing detailed description of two preferred embodiments taken in conjunction with the drawings.

DESCRIPTION OF THE PREFERRED EMBODIMENTS

Figure 1:
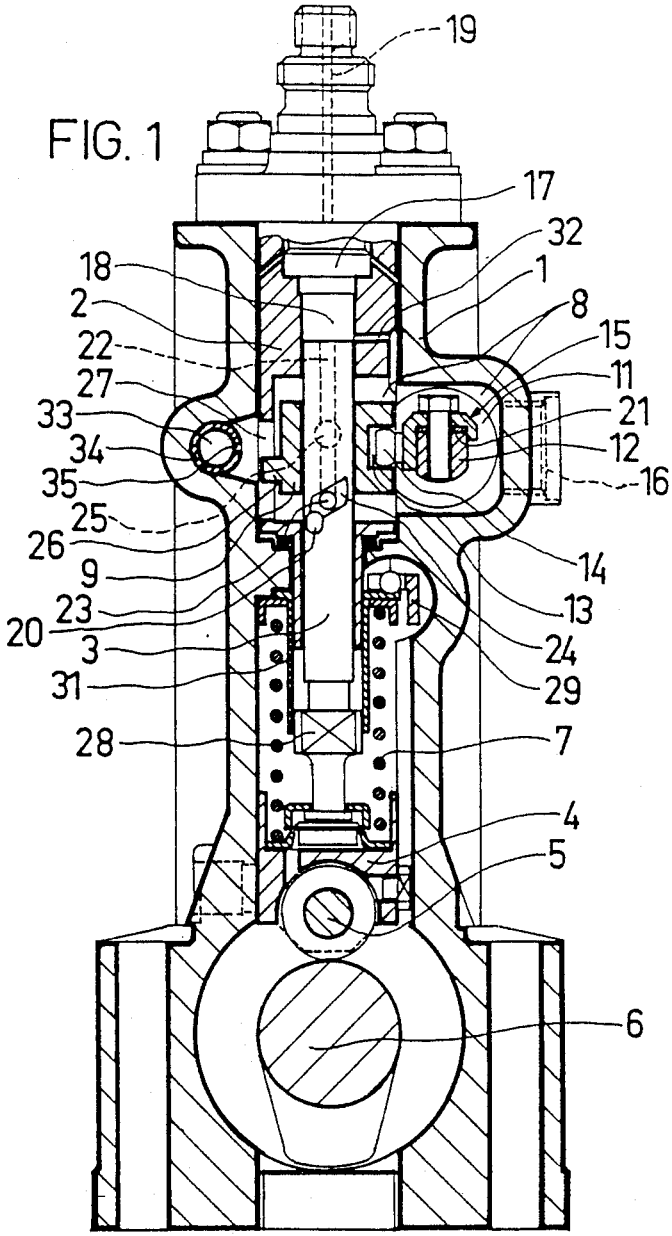
FIG. 1 is a vertical cross section taken through a fuel injection pump according to the invention.

In the fuel injection pump shown in FIG. 1, which is equally applicable to both exemplary embodiments, a plurality of cylinder liners 2 are set in line into a housing 1, only one of the liners being visible because of the location of the section line. In the cylinder liners 2, one pump piston 3 each, with the interposition of a roller tappet 4 that has a roller 5, is driven by a camshaft 6 counter to the pump feed pressure and to the force of a spring 7 to effect the axial pump piston movement that embodies the working stroke. By means of recesses in the cylinder liners 2 and hollow spaces in the housing 1, a suction chamber 8 is formed, oriented toward the pump elements embodied by the cylinder liners 2 and pump pistons 3. One control slide 9 is axially displaceable on each of the pump pistons 3, in the recesses of the cylinder liners 2. The suction chamber 8 is closed at its long ends by bearing plates 11, one of which is shown in plan view, and in which a torque shaft 12 disposed in the suction chamber 8 is supported. A transverse groove 13 in the control slide 9 is engaged by a driver tang 14 of a fastening part 15 of the torque shaft 12, which part 15 is connected to the torque shaft 12. In the housing 1, there are connecting bores 16, one of which is shown in the drawing, leading to the suction chamber 8.

The pump piston 3, the cylinder liner 2 and a pressure valve 17 define a pump work chamber 18, from which a pressure conduit leads to a pressure line (not shown) that terminates at an injection nozzle on the engine. In the pump piston 3, there is a blind bore 22, terminating on its face end and discharging into the pump work chamber 18, as well as a transverse bore 23, which terminates in oblique grooves 24, each of which is oriented toward sides remote from one another in the jacket face of the pump piston 3. These oblique grooves 24 terminate at the bottom in countersunk bores 20 and cooperate with radial bores 25 of the control slide 9.

To secure the control slide 9 against rotation during its axial displacement on the pump piston 3 and to assure an exact association of the oblique grooves 24 with the radial bores 25, the control slide 9 has a protrusion 26, with which it engages a longitudinal groove 27 of the cylinder liner 2.

The pump piston 3 has flattened portions 28 on its lower section, these portions being engaged by a sleeve 31 that is rotatable by a governor rod 29 in a known manner, so that an axial displacement of the governor rod 29 causes rotation of the pump piston 3 and hence effects a change in the association of the oblique grooves 24 with respect to the radial bores 25.

Extending in the cylinder liner 2 and in the pump housing 1 between the suction chamber 8 and the pump work chamber 18 is an intake bore 32, which is opened up by the pump piston 3 in its bottom dead center position as shown in the drawing.

The supply of fuel to the suction chamber 8 is effected via the longitudinal grooves 27 from an inflow conduit 33, which extends in a tube 34 that is disposed in the housing 1 and has branching openings 36 toward the longitudinal groove 27.

This fuel injection pump functions as follows:

Toward the end of the intake stroke, that is, in the bottom dead center position of the pump piston 3, fuel flows via the oblique grooves 24, the transverse bore 23 and the blind bore 22 as well as via the suction bore 32 into the pump work chamber 18 and fills it. As soon as the roller tappet 4, after suitable further rotation of the camshaft 6, is pushed upward via the roller 5, the pump piston 3 positively displaces fuel out of the pump work chamber 18. Until such time as the oblique grooves and the countersunk 20 have become fully immersed in the control slide 9, pumping from the pump work chamber 18 takes place by the above-described route back to the suction chamber 8, with a certain amount initially also being positively displaced back via the suction bore 32. As long as the oblique grooves 24 and the countersunk bores 20 are completely immersed in the control slide 9, an injection pressure can build up in the pump work chamber 18; after that, the supply of fuel to the engine takes place, via the pressure conduit 19. This actual injection stroke of the pump piston 3 is interrupted whenever the oblique grooves 24 are in coincidence with the radial bores 25, causing the fuel to be pumped back out of the pump work chamber 18 into the suction chamber 8.

Depending on the rotational position of the pump piston, determined by the governor rod 29, this actual injection stroke is of variable length, since in accordance with the rotational position the oblique grooves 24 are in coincidence with the radial bores 25 only after a certain length of the stroke. This determines the injection quantity. The injection onset, contrarily, is determined by the axial position of the control slide 9, which in turn is effected by the torque shaft 12, or its fastening part 15 and driver tang 14. The higher the level to which the control slide has been displaced, the later the injection onset begin (entry of the oblique grooves 24 into the control slide 9), and accordingly the later the injection ceases, so that the quantity determined by the rotational position of the pump piston 3 remains unchanged. This injection onset or the end of injection, respectively, must agree for all the pump element of one line.

Since errors in tolerance are intrinsic in the manufacture and assembly of the fuel injection pump, these errors must be corrected prior to the use of the fuel injection pump with an engine. That is, in a predetermined rotational position of the torque shaft 12, all the control slides must assume exactly the same axial, or stroke, position with respect to the oblique grooves 24. This is attained by disposing spacer means 21 in the stroke direction between the torque shaft 21 and the fastening part 15, these spacer means determining the location of the driver tang 14 with respect to the torque shaft 12 in the stroke direction.

Figure 2:
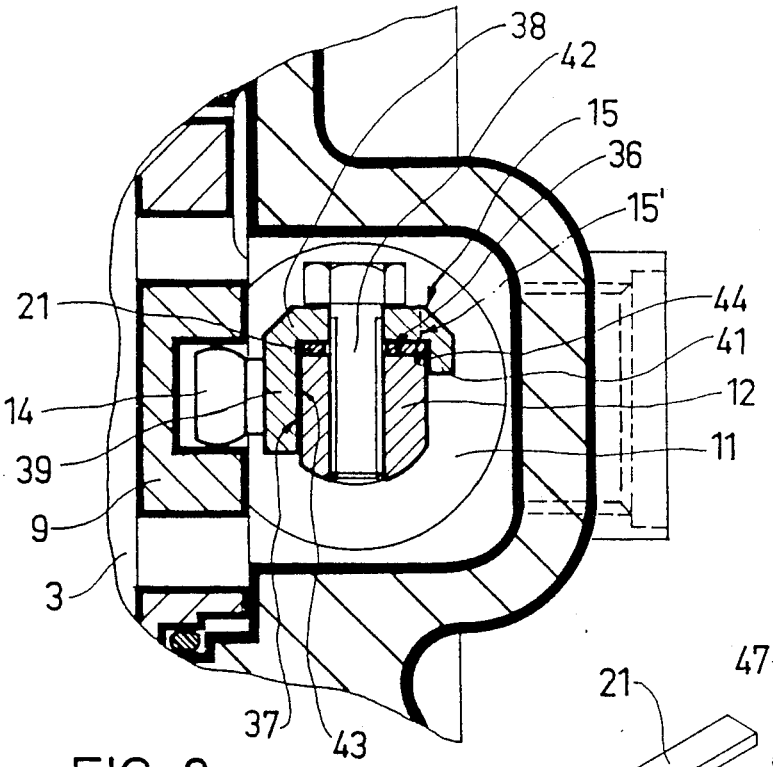
FIG. 2 is a partial view of FIG. 1 showing a detail of the first exemplary embodiment of FIG. 1 on a larger scale.
Figure 3:
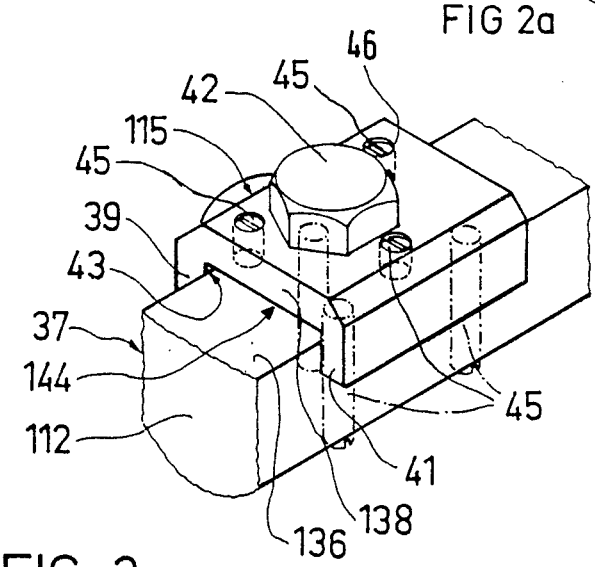
FIG. 3 is a perspective view of a variant of the exemplary embodiment of FIG. 1.

In the first exemplary embodiment shown in FIGS. 2 and 3, the torque shaft 12, 112 is embodied as a profile rod, having a flat horizontal face 36, 136 and a flat vertical face 37. The two faces 36 and 37 form a right angle. The fastening part 15, 115 has a U-shaped cross section, with a base plate 38, 138 and two legs 39 and 41 of unequal length, with which the fastening parts 15, 115 are guided in a form-locking manner on the torque shaft 12, 112. The driver tang 14 is disposed on the leg 39. The base plate 38, 138 and thus the fastening part 15, 115 is secured to the torque shaft 12, 112 by a hexagonal head screw that serves as a fastening means 42. This hexagonal head screw 42 may be embodied as a dowel screw, with a corresponding fitted guidance in the bore penetrated by it in the fastening part, so that even when the fastening part is embodied as a simple angle—as suggested by the dot-dash line 15' on the fastening part 15—there is sufficient vertical guidance. The vertical face 37 is in constant contact with a guide face 43 of the fastening part 15, 115. Opposite the horizontal face 36 is an adjusting face 44, 144 of the fastening part 15, 115.

Figure 2A:
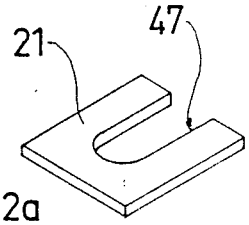
FIG. 2*a* is a perspective view of a shim from FIG. 2.

In the variant shown in FIG. 2, shims serving as the spacer means 21 are inserted in between the horizontal face 36 and the adjusting face 44; the thickness of the shims is equivalent to the stroke position correction for the control slide 9 and hence to the location of the driver tangs 14. These shims have a longitudinal slit 47 open at one end, which encompasses the fastening means 42 in U-like fashion (see FIG. 2*a*).

In the variant shown in FIG. 3, the vertical spacing between the horizontal face 136 and the adjusting face 144 is attained by means of three set screws 45 serving as spacer means which extend in corresponding threaded bores 46 in the base plate 138 which provides the spacing by being thread against the horizontal face 136 of the torque shaft 112 prior to the fastening part 115 being fastened tightly by the hexagonal screw. An alternative version is shown in dot-dash lines, in which threaded cylindrical rods 45' extend in corresponding threaded bores 46' with the upper end protruding above the horizontal face 136 of the torque shaft 112 which upper ends brace on the bottom face of the fastening part 115. In this version, more space is available for tool access, for turning the set screws.

For adjusting the individual control slides 9 with respect to one another, the fuel injection pump is assembled, with all the errors in tolerance there may be, and the stroke deviations of the individual control slides are measured, in particular electronically, with an average spacing distance being set by the spacer means. After that, the torque shaft 12, 112 including the fastening parts 15, 115 and the driver tangs 14 is removed, via the openings in the bearing plates 11, and shims of an exact thickness, serving as the spacer means 21, are then introduced in between the horizontal face 36 and the adjusting face 14; these shims replace the shims of average thickness and precisely compensate for these stroke errors; alternatively, the three set screws 45 or 45' may serve as spacer means which are adjusted by being turned farther into or out of their bores 46 or 46' to move the torque shaft 112 and the fastening part 115 out of the average setting. In this process, the guide face 43 in cooperation with the vertical face 37 serves to provide exact guidance in the desired stroke direction. Once the fastening parts 15, 115 have been tightened by the hexagonal screws, the torque shaft 12 is inserted back into the pump, after which the individual control slides 9 assume the desired exact control location.

Figure 4:
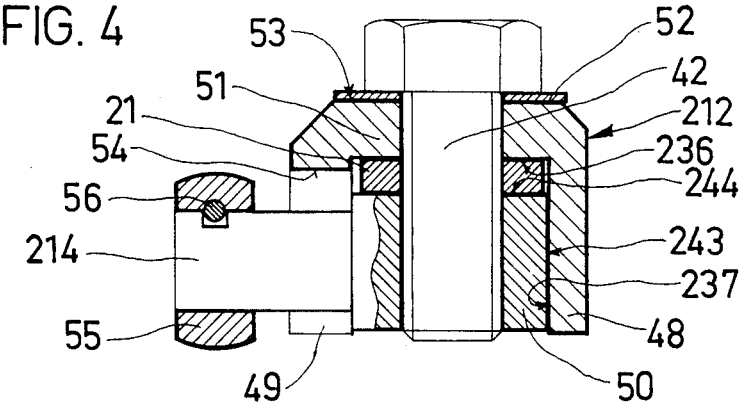
FIGS. 4–6 show the second exemplary embodiment in three variants corresponding to the view of FIG. 2.
Figure 5:
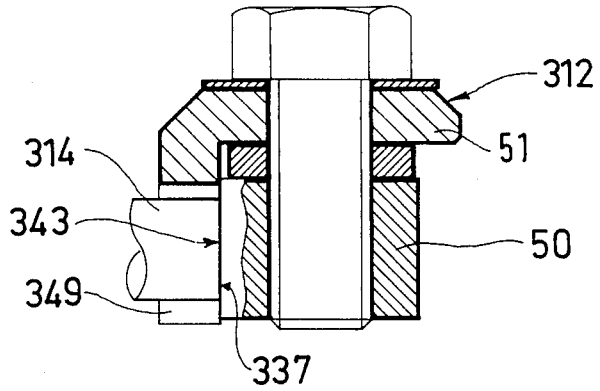
Figure 6:
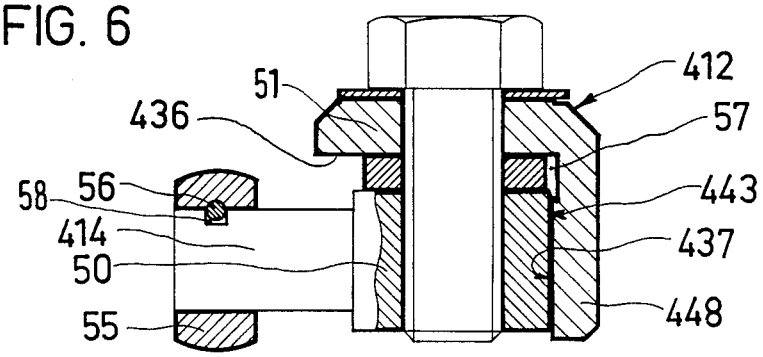

For the second exemplary embodiment, shown in three variants in FIGS. 4–6, only the disposition between the fastening part and the driver tang is shown, and the reference numerals of identical parts in the variants shown are used again, simply raised by the number 200, 300 or 400.

In the variant shown in FIG. 4, the fastening part 15, 115 as shown in FIGS. 1 and 3 now becomes the torque shaft 212 which has a U-shaped cross section, and between the legs 48 and 49 of this torque shaft 212, a prismaticaly shaped profile element serving as a fastening part 50 is inserted and clamped firmly by means of the hexagonal screw on a crosspiece 51 of the U-shaped profile of the torque shaft 212. The hexagonal screw here is braced with its hexagonal head via a shim 52 on a face 53 of the torque shaft 212. In this second exemplary embodiment, reference numeral 50 will now be assigned to the profile element serving as the fastening part for the driver tang 214.

The shim 21 is fastened in place between the horizontal face 236 of the crosspiece 51 of the torque shaft 212 and the adjusting face 244 oriented toward the cross piece on the profile element 50. This shim 21 has corresponding faces parallel to these faces and also has the same task as in the first exemplary embodiment.

An additional guidance is produced by the profile element 50 in that its vertical guide face 243 is located on a vertical face 237, oriented toward it, of the leg 48. As a result, it is assured that the driver tang 214 protrudes outward at right angles to the torque shaft axis. This driver tang 214 passes through a free opening 54 provided toward the bottom for the insertion of the driver tang 214, and the profile element 50 is fitted in between the legs 49 and 50. A slide block 55 is disposed on the driver tang 214, secured against slipping by a pin 56 and with its upper and lower curved surface, respectively, engaging the corresponding faces of the transverse groove 13 of the control slide 9 such as shown in FIG. 1.

In the variants shown in FIGS. 5 and 6, the cross section of the torque shaft 312 or 412 is L-shaped, and unlike the variant shown in FIG. 4, the vertical leg 349 is on the left in FIG. 5 and the vertical leg 448 is on the right in FIG. 6, and thus, serve as the sole vertical guide.

In the variant of the exemplary embodiment shown in FIG. 5, the vertical face 337 on the leg 349, in combination with the guide face 343 on the profile element 50, takes over the task of guidance, because the driver tang 214 is perpendicular with respect to the torque shaft axis.

In the additional variant of the embodiment that is shown in FIG. 6, as in the embodiment of FIG. 4 this guidance is taken over by the vertical face 437 on the leg 448 and by the guide face 443 on the profile element 50. To assure satisfactory contact, a relief groove 57 can be provided, as in the other variants as well, in the vicinity of the contact with the leg. The sliding block 55 in this variant as well is secured by a pin 56, which eccentrically intersects with the driver tang 414 in a tangential groove 58.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having a pump housing a plurality of pump elements in a line in said pump housing and driven by a common camshaft, each pump element having one pump piston having a longitudinal axis and one pump cylinder which defines one pump work chamber, a control slide axially displaceable on each pump piston, controlling at least one control opening that extends in the pump piston and which communicates with said pump work chamber and which discharges in a jacket face of the pump piston, a torque shaft interconnecting each of said control slides is provided for a simultaneous actuation of all of said control slides for controlling the fuel quantity and/or the supply onset or the end of supply, said torque shaft being supported in said pump housing, torque shaft driver tangs are provided that are adjustable with respect to said torque shaft for varying the stroke position of the control slide, and having one each transverse groove extending transversely to the pump piston axis, on each control slide, which transverse groove is engaged by said driver tangs for axially actuating each respective control slide, each drive tang (14) has a fastening part (15; 15'; 50; 115) for fastening said driver tang to said torque shaft (12; 112; 212; 312; 412), said fastening part having an adjusting face (44; 144; 244) oriented toward said torque shaft (12; 112; 212; 312; 412) and extending transversely to the pump piston longitudinal axis, and spacer means (21; 45; 45') for adjusting a spacing between said adjusting face (44; 144; 244) and the torque shaft (12; 112; 212; 312; 412) for adjusting the stroke position of the respective control slide (9).

2. A fuel injection pump as defined by claim 1, in which said spacer means (21) are shims, which are insertable between the adjusting face (44) and the torque shaft (12).

3. A fuel injection pump as defined by claim 2, in which said shims have a slit, open at one end, for receiving fastening means (42).

4. A fuel injection pump as defined by claim 1, in which said spacer means (45) are threaded set screws threaded in said torque shaft (112) which are each braced on a face of said fastening part located opposite said threaded set screws thereby determine the spacing between said torque shaft and said fastening part.

5. A fuel injection pump as defined by claim 1, in which said spacer means (45) are threaded set screws threaded in said fastening part (115) which are each braced on a face of said torque shaft (112) located opposite said threaded set screws thereby determining the spacing between said fastening part and said torque shaft.

6. A fuel injection pump as defined by claim 1, in which torque shaft (12; 112) has, at least in said vicinity of the fastening parts (15; 115), a profile cross section having horizontal faces (36; 136), to which adjusting faces (44; 144) of the fastening parts (15; 115) correspond.

7. A fuel injection pump as defined by claim 2, in which torque shaft (12; 112) has, at least in said vicinity of the fastening parts (15; 115), a profile cross section having horizontal faces (36; 136), to which adjusting faces (44; 144) of the fastening parts (15; 115) correspond.

8. A fuel injection pump as defined by claim 4, in which torque shaft (12; 112) has, at least in said vicinity of the fastening parts (15; 115), a profile cross section having horizontal faces (36; 136), to which adjusting faces (44; 144) of the fastening parts (15; 115) correspond.

9. A fuel injection pump as defined by claim 5, in which torque shaft (12; 112) has, at least in said vicinity of the fastening parts (15; 115), a profile cross section having horizontal faces (36; 136), to which adjusting faces (44; 144) of the fastening parts (15; 115) correspond.

10. A fuel injection pump as defined by claim 1, in which said fastening parts (15), on the side oriented toward the torque shaft (12) and at least in the vicinity of the control slides (9), have guide faces (43) extending largely parallel to a plane extending through the pump piston axes.

11. A fuel injection pump as defined by claim 2, in which said fastening parts (15), on the side oriented toward the torque shaft (12) and at least in the vicinity of the control slides (9), have guide faces (43) extending largely parallel to a plane extending through the pump piston axes.

12. A fuel injection pump as defined by claim 4, in which said fastening parts (15), on the side oriented toward the torque shaft (12) and at least in the vicinity of the control slides (9), have guide faces (43) extending largely parallel to a plane extending through the pump piston axes.

13. A fuel injection pump as defined by claim 5, in which said fastening parts (15), on the side oriented toward the torque shaft (12) and at least in the vicinity of the control slides (9), have guide faces (43) extending largely parallel to a plane extending through the pump piston axes.

14. A fuel injection pump as defined by claim 6, in which said fastening parts (15), on the side oriented toward the torque shaft (12) and at least in the vicinity of the control slides (9), have guide faces (43) extending largely parallel to a plane extending through the pump piston axes.

15. A fuel injection pump as defined by claim 6, in which said fastening parts (15, 115) have an angular shaped cross section, on one leg (39) of which the driver tang (14) and the guide face (43) are disposed and on which, extending at right angles to this leg, the adjusting face (44) is provided.

16. A fuel injection pump as defined by claim 10, in which said fastening parts (15, 115) have an angular shaped cross section, on one leg (39) of which the driver tang (14) and the guide face (43) are disposed and on which, extending at right angles to this leg, the adjusting face (44) is provided.

17. A fuel injection pump as defined by claim 6, in which said fastening parts (15, 115) have an U-shaped cross section, on one leg (39) of which the driver tang (14) and the guide face (43) are disposed and on which, extending at right angles to this leg, the adjusting face (44) is provided.

18. A fuel injection pump as defined by claim 10, in which said fastening parts (15, 115) have an U-shaped cross section, on one leg (39) of which the driver tang (14) and the guide face (43) are disposed and on which, extending at right angles to this leg, the adjusting face (44) is provided.

19. A fuel injection pump as defined by claim 6, in which said torque shaft (212; 312; 412) has a profile cross section having at least two legs (48; 49; 51; 349; 448) at right angles to one another, said torque shaft cooperating with and covering said fastening part (50) is embodied prismatically on two sides (243; 244), and that on one of the legs (51), the horizontal face that extends transversely to the pump piston axis and is oriented in the intake stroke direction is provided to cooperate with the adjusting face (244) of the fastening part (50).

20. A fuel injection pump as defined by claim 10, in which said torque shaft (212; 312; 412) has a profile cross section having at least two legs (48; 49; 51; 349; 448) at right angles to one another, said torque shaft cooperating with and covering said fastening part (50) is embodied prismatically on two sides (243; 244), and that on one of the legs (51), the horizontal face that extends transversely to the pump piston axis and is oriented in the intake stroke direction is provided to cooperate with the adjusting face (244) of the fastening part (50).

21. A fuel injection pump as defined by claim 19, in that the profile of said torque shaft cross section is a U or L open in the intake direction, with a vertical face (237; 337; 437) oriented toward the fastening part (50) and parallel to a tensioning screw axis, and said fastening part (50), includes a guide face (243; 343; 443) that rests on said vertical face.

22. A fuel injection pump as defined by claim 20, in that the profile of said torque shaft cross section is a U or L open in the intake direction, with a vertical face (237; 337; 437) oriented toward the fastening part (50) and parallel to a tensioning screw axis, and said fastening part (50), includes a guide face (243; 343; 443) that rests on said vertical face.

23. A fuel injection pump as defined by claim 19, in which a relief groove (57) is provided in the vertical face at the transition to the horizontal face.

24. A fuel injection pump as defined by claim 20, in which a relief groove (57) is provided in the vertical face at the transition to the horizontal face.

25. A fuel injection pump as defined by claim 19, in which said fastening part (50) includes a driver tang (214; 314; 414) secured for engagement with a transverse groove (13) in said control slide.

26. A fuel injection pump as defined by claim 21, in which said fastening part (50) includes a driver tang (214; 314; 414) secured for engagement with a transverse groove (13) in said control slide.

27. A fuel injection pump as defined by claim 23, in which said fastening part (50) includes a driver tang (214; 314; 414) secured for engagement with a transverse groove (13) in said control slide.

28. A fuel injection pump as defined by claim 1, in which said fastening part is firmly clamped on said torque shaft at least by means of a screw fastening means (42).

29. A fuel injection pump as defined by claim 4, in which said fastening part is firmly clamped on said torque shaft at least by means of a screw fastening means (42).

30. A fuel injection pump as defined by claim 5, in which said fastening part is firmly clamped on said torque shaft at least by means of a screw fastening means (42).

31. A method of adjusting a control slide of each pump piston of a fuel injection pump for internal combustion engines which comprises assemblying a torque shaft assembly including a torque shaft and a fastening part having a tang that cooperates with said control slide within said fuel injection pump, determining control slide errors for each control slide of said fuel injection pump, removing said shaft assembly from said fuel injection pump, changing a spacing between horizontal facing surfaces of said torque shaft and said torque shaft and said fastening part in accordance with the predetermined stroke errors, securing said horizontal surfaces in place relative to each other, and repositioning said torque assembly within said fuel injection pump thereby adjusting any errors of each individual control slide.

* * * * *